US012458899B2

(12) United States Patent
Leung

(10) Patent No.: US 12,458,899 B2
(45) Date of Patent: Nov. 4, 2025

(54) PLUSH TOY WITH LAYER OF MANUALLY REMOVABLE PLUSH

(71) Applicant: MGA Entertainment, Inc, Chatsworth, CA (US)

(72) Inventor: Alfred Leung, Tin Shui Wai (HK)

(73) Assignee: MGA Entertainment, Inc, Chatsworth, CA (US)

( * ) Notice: Subject to any disclaimer, the term of this patent is extended or adjusted under 35 U.S.C. 154(b) by 308 days.

(21) Appl. No.: 18/310,931

(22) Filed: May 2, 2023

(65) Prior Publication Data

US 2024/0367064 A1 Nov. 7, 2024

(51) Int. Cl.
*A63H 3/02* (2006.01)
*A63H 9/00* (2006.01)

(52) U.S. Cl.
CPC ..... *A63H 3/02* (2013.01); *A63H 9/00* (2013.01)

(58) Field of Classification Search
CPC . A63H 3/005; A63H 3/02; A63H 3/16; A63H 3/36; A63H 9/00; A63H 33/004
USPC ..... 446/73, 100, 321, 369, 372
See application file for complete search history.

(56) References Cited

U.S. PATENT DOCUMENTS 1,023,401 A * 4/1912 Trowbridge ..... A63H 3/02 446/369
1,307,218 A * 6/1919 Spencer ..... A63H 3/02 446/369
1,442,761 A * 1/1923 Beach ..... A63H 3/26 601/154
1,630,165 A * 5/1927 Butler ..... A63H 3/02 446/369
2,274,303 A * 2/1942 Ornstein ..... A63H 3/16 446/99
3,831,316 A * 8/1974 Weistrop ..... A63H 3/36 446/369
4,122,628 A * 10/1978 Crowell ..... A63H 3/02 446/385
4,208,832 A * 6/1980 Corriveau ..... A63H 3/02 446/369
4,288,222 A * 9/1981 Kling ..... G09B 23/34 446/73

(Continued)

FOREIGN PATENT DOCUMENTS

CA 2597959 A1 * 7/2008 ..... A63H 3/44
CN 202526897 4/2014

(Continued)

OTHER PUBLICATIONS

Fidget_Ball-Pullers Pickers Fidget Ball™—Nov. 12, 2020—webArchive—Therapy Shoppe.

(Continued)

*Primary Examiner* — Alexander R Niconovich
(74) *Attorney, Agent, or Firm* — Thomas Coester Intellectual Property

(57) ABSTRACT

A plush toy having a body at least partially formed from dual plush fabric. The fabric has a backing, a second plush layer having a second pile height and fixedly coupled to the backing by a laminate layer and a first plush layer removably coupled through the backing. The first plush layer has a first pile height greater that the second pile height. The body defines and internal cavity that retains a fill material.

8 Claims, 5 Drawing Sheets

(56) References Cited

U.S. PATENT DOCUMENTS 4,413,442 A * 11/1983 McSweeney ..... A63H 3/02 446/73
4,614,505 A * 9/1986 Schneider ..... A63H 33/004 446/369
4,695,264 A * 9/1987 McLeod, Jr. ..... A63H 33/004 446/369
4,715,840 A * 12/1987 Swift ..... A63H 3/005 446/73
4,781,648 A * 11/1988 Garfinkel ..... A63H 33/004 446/369
4,822,285 A * 4/1989 Summerville ..... A63H 3/003 446/302
4,979,924 A * 12/1990 Manger ..... A63H 3/16 446/901
5,090,938 A * 2/1992 Reynolds ..... G09B 19/0061 434/137
5,115,528 A * 5/1992 Lamle ..... A63H 3/003 5/636
5,123,870 A * 6/1992 Cahill ..... A63H 3/02 446/385
5,129,853 A * 7/1992 Bowling ..... A63H 3/44 446/296
5,178,807 A * 1/1993 Thary ..... B32B 5/20 427/245
5,182,845 A * 2/1993 Dean ..... A63H 3/02 29/469
5,348,510 A * 9/1994 DuPont ..... A63H 3/365 2/209.12
5,746,639 A * 5/1998 Bloom ..... A63H 3/52 446/369
6,048,248 A * 4/2000 Ritchey ..... A63H 3/003 446/369
6,280,283 B1 * 8/2001 Sisler ..... A63H 3/365 446/369
6,663,457 B2 * 12/2003 Ritchey ..... A63H 3/02 446/76
7,887,387 B2 * 2/2011 Colvin ..... A63H 3/005 446/379
10,022,642 B1 * 7/2018 Adams ..... G09B 19/20
10,427,061 B2 * 10/2019 Medwed ..... A63H 3/02
11,192,042 B2 * 12/2021 Hawkins ..... A63H 3/02
11,623,156 B1 * 4/2023 Medwed ..... A63H 3/02 446/369
2006/0282338 A1 * 12/2006 Cope ..... A63H 9/00 705/26.1
2007/0248940 A1 * 10/2007 Maguire ..... G09B 19/00 446/369
2009/0088045 A1 * 4/2009 Kotzer Jacobs ..... D05B 97/00 112/475.08
2011/0117809 A1 * 5/2011 Bowar ..... A63H 3/005 446/369
2012/0073032 A1 * 3/2012 Tigan ..... A42B 1/004 446/376
2018/0369704 A1 * 12/2018 Whitaker ..... A63H 3/36
2019/0274285 A1 * 9/2019 Stone ..... A01K 15/026
2024/0238683 A1 * 7/2024 Badie ..... A63H 3/04
2025/0032944 A1 * 1/2025 Zhang ..... A63H 3/02
2025/0058237 A1 * 2/2025 Maldovan ..... A63H 3/02

FOREIGN PATENT DOCUMENTS

JP 2003169966 A * 6/2003
JP 2009100968 A * 5/2009
TW 327245 2/2008
WO WO-2019090407 A1 * 5/2019 ..... A63H 9/00

OTHER PUBLICATIONS

Agrimony Cute Shaved Sheep Stuffed Animals Kawaii Lamb Plush Toys Birthday Funny Gifts for Women Girls Boys Kids Teens Small Plushies Sheep Decor—2022.

* cited by examiner

PLUSH TOY WITH LAYER OF MANUALLY REMOVABLE PLUSH

BACKGROUND

Field

Embodiments of the invention relate to plush toys. More specifically, embodiments of the invention relate to plush toys having two layers of plush with at least one layer being manually removable.

Background

Plush toys are toys made of soft material, often a fur type of fabric, for example a Teddy Bear. Plush toys are also referred to as a stuffed toy, stuffed animal, plushie, plush-toy, soft toy, plushy. They have been a quintessential childhood plaything for decades. Plush toys are typically made by forming the body from plush fabric. Filling the body with some type of soft filler material through a fill hole and closing the fill hole often with a ladder stich. Plush fabric is a thick or deep pile fabric generally made by knitting a backing with pile fibers of a desired length and then laminating the fibers to the backing to prevent the fabric from shedding during use.

Traditionally, plush toy came in a myriad shapes and sizes, from animals to humanoids to almost any imaginable shape. The may have features embossed or embroidered on their surface. Some come with changes of outfits or skins that can be peeled off and changes then reapplied. Recently some manufacturers have made "reversable" plush toys that fold within themselves to reveal a different shape or appearance. Changes in plush toys are largely driven by the desire to improve the play experience for the user. What is needed is a plush toy that provides a unique and memorable play experience.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

DETAILED DESCRIPTION

Figure 1B:
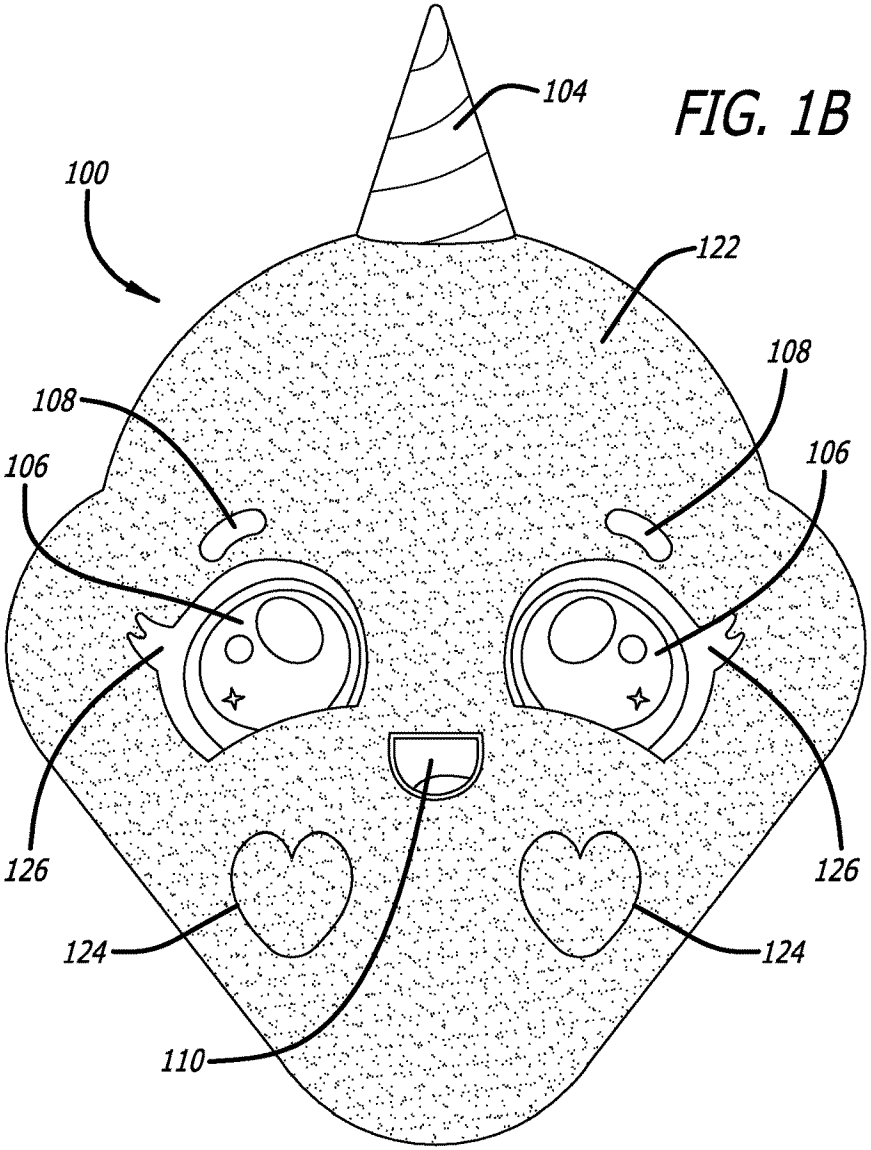
FIG. 1B is a view of a plush toy after an exterior plush layer has been removed according to one embodiment of the invention.
Figure 1A:
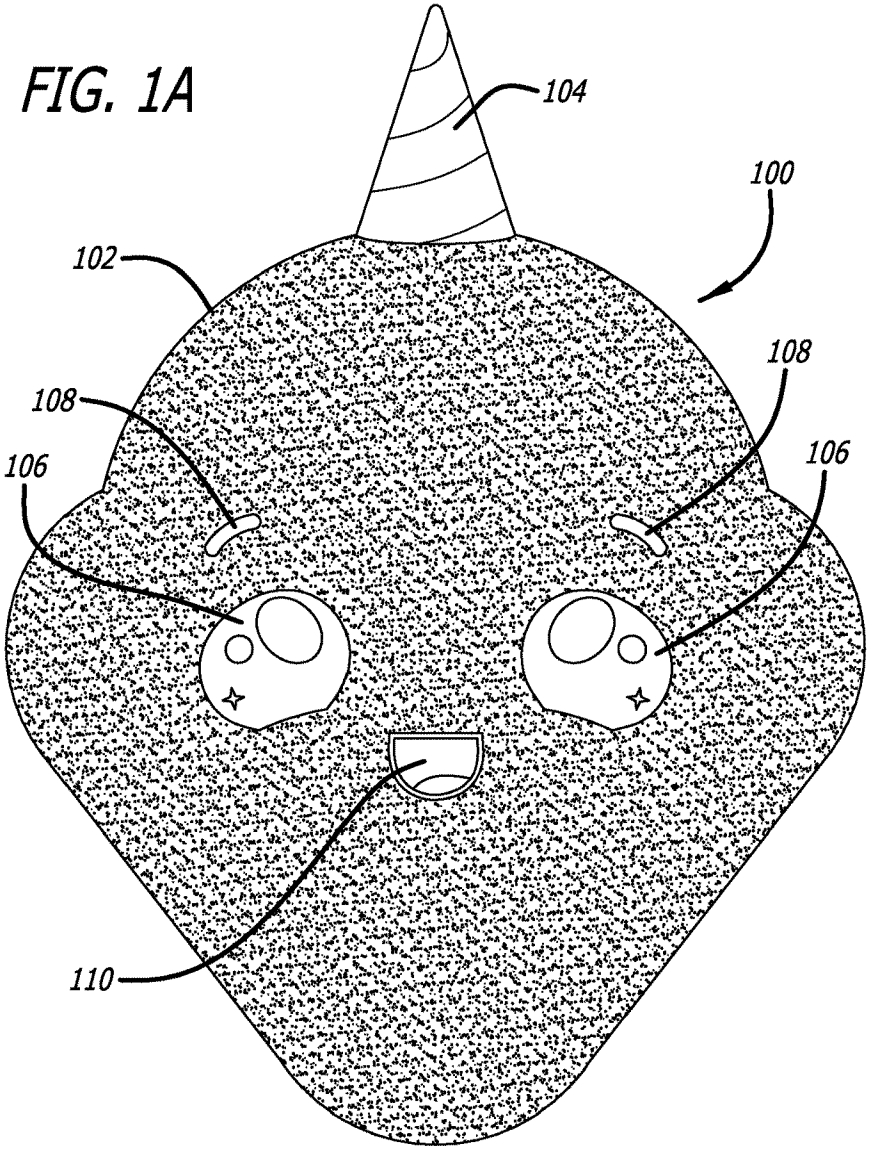
FIG. 1A is a view of a plush toy with two plush layers according to one embodiment of the invention.

FIG. 1A is a view of a plush toy with two plush layers according to one embodiment of the invention. While the plush toy 100 has two layers of plush, only the shag layer 102 is visible in this figure. Shag layer 102 has a pile height greater that than the second plush layer (base layer 122 in FIG. 1B). Shag layer is formed of thread having a first thread weight. Plush toy 100 may have various ornamental/aesthetic ("ornamental" and "aesthetic" are used interchangeably herein) features such as eyes 106, eyebrows 108 and mouth 110 that are visible through shag layer 102. In some embodiments, the ornamental features 106, 108 and/or 110 may be embossed or embroidered onto the underlying plush fabric from which the body of plush toy 100 is formed. Shag layer 102 may be a single color, e.g., blue, red, green etc., or may be multicolored such as a rainbow pattern, leopard print or the substantially any desired pattern. Shag layer 102 is coupled to an underlying backing layer (not shown in this figure) in a manner that allow it to be readily removed by hand as more fully described with reference to FIG. 2 below.

In some embodiments, additional features such as horn 104 may be formed from a different material than the body of plush toy 100. In the shown embodiment horn 104 is formed from a smooth fabric with its shape maintained by a poly-fill material. Other fill materials are also contemplated. Further it should be understood that embodiments of the invention contemplate plush toys made to include plastic parts (e.g. eyes, hands faces etc.) or parts made from single layer plush fabric.

FIG. 1B is a view of a plush toy after an exterior plush layer has been removed according to one embodiment of the invention. Removal of shag layer (102 from FIG. 1) from plush toy 100 reveals the second plush layer, base layer 122. Base layer 122 has a pile height less than the pile height of shag layer 102. Base layer 122 is formed from thread having a second thread weight.

Base layer 122 may be a different color and or pattern of colors than shag layer. Generally, it is desirable for the second thread weight to be less than or equal to the first thread weight of the shag layer 102. By virtue of greater pile height and greater thread weight, in some embodiments, the shag layer 102 completely occludes the base layer 122. In such embodiments, the e.g., color of the base layer 122 is unknown until the at least a portion of the shag layer 102 is removed.

Base layer 122 may have additional ornamental features 124 embossed, embroidered or otherwise affixed to base layer 122 in a manner that they are not visible when shag layer 102 is present. Some of the ornamental feature visible through the shag layer 102 such as eyes 106 may have additional ornamental features 124 associated therewith that are not visible when the shag layer 102 is present. Other features such as eyebrows 108 may have a different extent when the shag layer 102 is removed.

This provides for a unique play experience as the appearance of the toy under the shag layer is unknown by the child when the plush toy 100 is unboxed. Different toys of the same model can have different underlying aesthetics (color, embossments etc.) with different sets of aesthetics having different rarity increasing the collectability of the toys. The joy an excitement experienced by the child as each feature is revealed by the manual bit by bit removal of the shag layer 102 is completely different than the experience of merely unwrapping an item. Additionally, the grasping an pulling of the plush fabric works fine motor skills of younger children.

Figure 2:
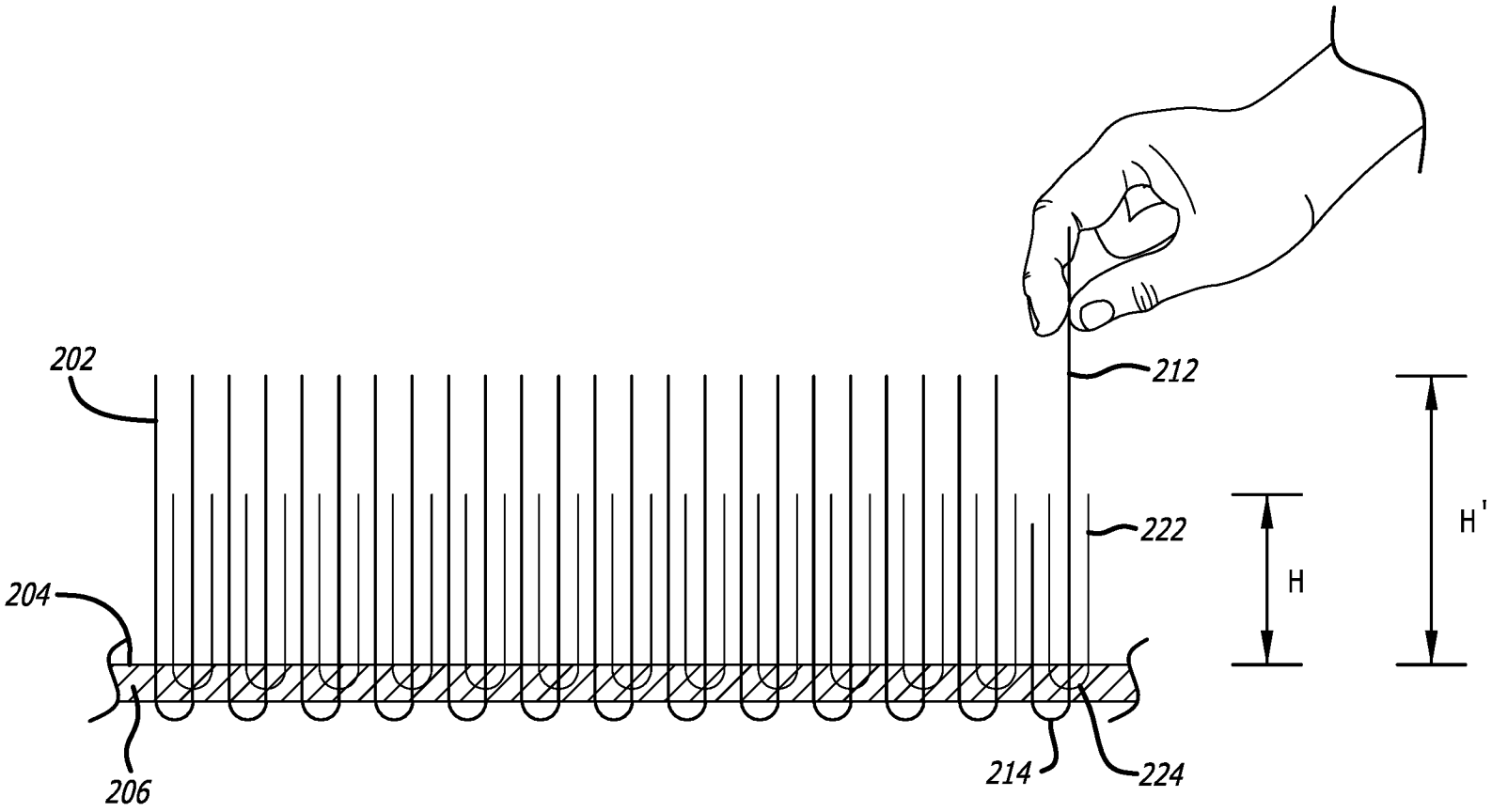
FIG. 2 is a schematic view of a plush fabric used to make plush toys according to one embodiment of the invention.

FIG. 2 is a schematic view of a plush fabric used to make plush toys according to one embodiment of the invention. A backing 204 has a first plush layer, base layer 222 knitted there through. Backing 204 could be knitted polyester, knitted cotton, another knitted synthetic or any similar backing traditionally used in the creation of plush fabrics. The distal portion 224, the portion furthest from the exposed ends of the plush of base layer 222, is laminated to the backing 204 by a laminate layer 206. Once lamination is complete, that is the laminate layer 206 is cured, the base layer 222 is permanently affixed to the backing. Based layer 222 has a pile height H. In some embodiments H is generally in a range of 5 mm to 12 mm.

Thereafter, shag layer 202 is added by embroidering through the backing 204 and finished laminate layer 222. Shag layer is not laminated to the composite fabric and distal end 214 are not permanently affixed to the composite fabric. Rather, shag layer 202 is detachably coupled through the backing to be manually removable. In this way, individual threads 212, or groups thereof can be pulled by hand from the fabric. As more threads 212 of shag layer 202 are removed, the underlying base layer 222 is exposed. Shag layer has a pile height H'. In some embodiments H' is in the range of 10 mm to 15 mm. In some embodiments the pile heights are selected to have a difference in the range of 3 mm to 10 mm.

Figure 3:
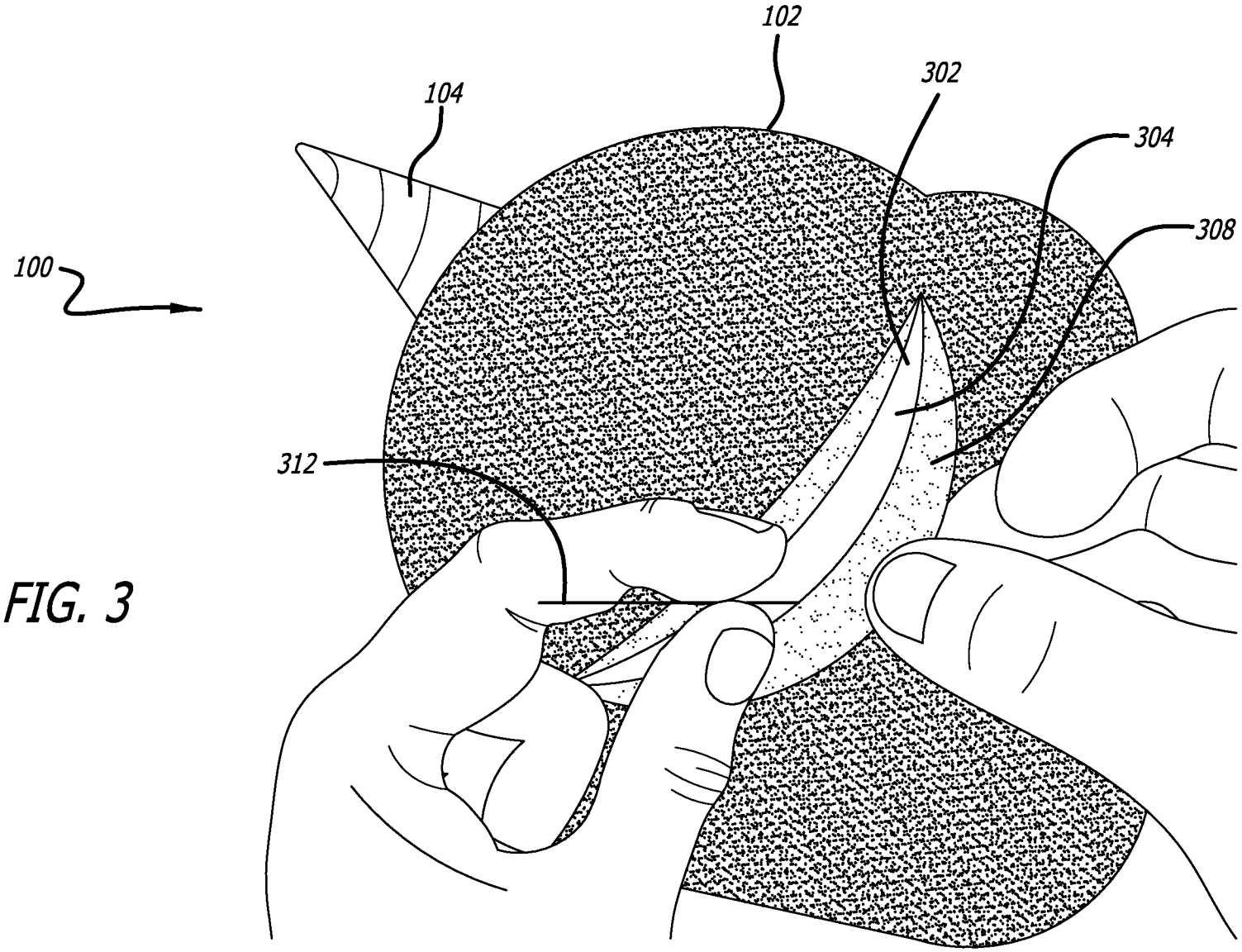
FIG. 3 is a rear view of a plush toy according to one embodiment of the invention.

FIG. 3 is a rear view of a plush toy according to one embodiment of the invention. Plush toy 100 is shown prior to the removal of the shag layer 102. In some embodiments, the fabric forming the body of the plush toy 100 defines and opening 302 into a pocket 304. Pocket 304 may be formed of woven material such woven cotton or the like and resides internal to the body during normal use. The pocket material should be selected to have a sufficiently tight weave to prevent leaking of fill material from within the primary body cavity. Opening 302 may be provided with a closure mechanism 308 such as hook and loop material, a zipper, snaps, buttons or the like.

The pocket 304 and it closure 308 provide various play benefits. The user can use the pocket to hold the threads 312 removed from the shag layer. By adding the shag layer threads to the pocket 304, the overall fill of the plush toy can be increased as the shag layer 102 is removed. Furthermore, the manipulation of the closure further enhances the users fine motor skills. While pocket 304 is believed to enhance the play experience in certain contexts, it should be recognized that some embodiments of the invention may omit the opening 302, pocket 304, and closure 308 entirely. In an embodiment, with no pocket, a envelope of polyethylene vinyl acetate (PEVA) or similar material may be provided with the toy to retain the removed fibers.

Figure 4:
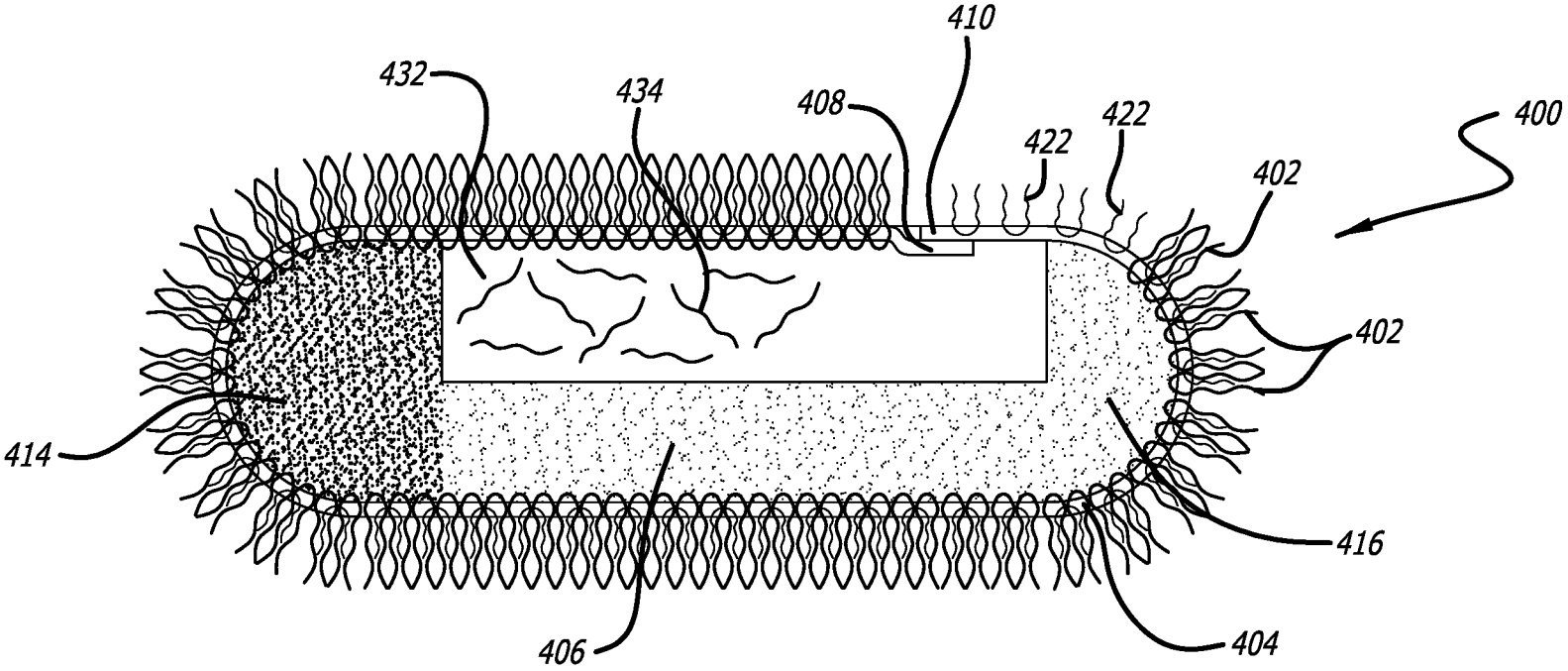
FIG. 4 is a schematic cross sectional view of a plush toy according to one embodiment of the invention.

FIG. 4 is a schematic cross sectional view of a plush toy according to one embodiment of the invention. Dual plush fabric 404 has a shag layer 402 and a base layer 422. Fabric 404 is formed generally as described with reference to FIG. 2 above such that shag layer 402 detachably coupled through the backing to be manually removable to expose base layer 422. While most of the plush toy 400 is shown with its shag layer 402 still attached, a region adjacent to a pocket opening 408 is shown removed to expose the base layer 422.

Fabric 404 forms a body with an internal cavity 406. Internal cavity 406 may be fill with various fill materials 414, 416. In some embodiment a single fill material e.g. fill material 416 may be used to fill the entire cavity 406. In other embodiments, two or more fill materials 414, 416 may be used. Suitable fill materials include synthetic fiber, cotton, straw, wood, wool, plastic pellets, beans or the like. Internal cavity 406 may have a pocket 432 to contain fibers 434 (that are removed from shag layer 402). Fabric 404 may define an opening 408 in the body that provide ingress into the pocket 432. A closure mechanism 410 may be attached to the fabric 404 at the opening 408. Closure mechanism 408 could be hook and loop material, a zipper, snaps, buttons or the like.

Figure 5:
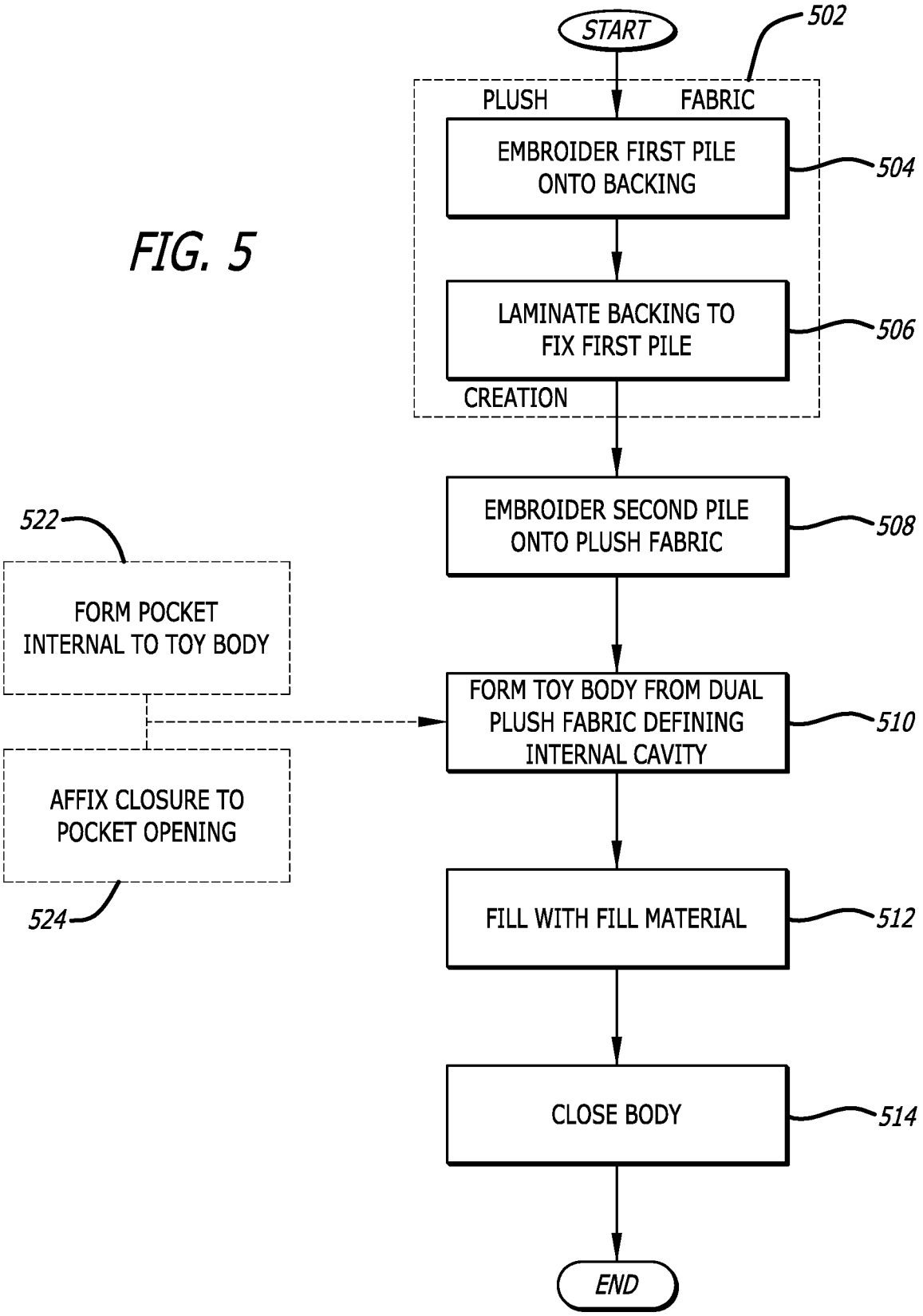
FIG. 5 is a flow diagram of manufacture of a plush toy according to one embodiment of the invention.

FIG. 5 is a flow diagram of manufacture of a plush toy according to one embodiment of the invention. In one embodiment, a plush toy is created by forming a base plush fabric as represented by super block 502. A first pile is knitted on to a backing at block 504. The backing is a knitted material and could be formed of polyester or any traditional material from which plush backing have commonly been formed. At block 506, the backing is laminated to fix the first pile layer to the backing. In this way a single plush layer fabric is created. Alternatively commercially available plush fabric can be purchased and processed from block 508.

At block 508, a second pile is embroidered onto the fabric over the first pile that has been laminated onto the backing. The second embroidery is not laminated or otherwise fixed to the backing. Generally, the second embroidery has a pile height greater than the pile height of the first embroidery. In most embodiments, the color of the second pile is different from the color of the first pile. The fabric is now ready to be formed into a plush toy.

At block 510, the fabric is cut and sewn to form the body of the plush toy. Formation of the body is completed in the manner customary in the art. Any of the myriad plush toy shapes may be formed. The body formed defines an internal cavity. An opening is left in the body to allow the body to be filled once complete. Optionally, as part of forming the body, an internal pocket can be formed at block 522. The pocket resides within the internal cavity when the toy is completed. A closure mechanism is affixed to the pocket opening at block 524. Suitable closure mechanisms include hook and loop material, a zipper, snaps, buttons or the like.

At block 512, the internal cavity is filled with one or more fill materials through the opening left during body formation. Suitable fill materials include synthetic fiber, cotton, straw, wood, wool, plastic pellets, beans and the like. Once filled at block 514, the fill hole is closed typically with a ladder stich to prevent the fill from leaking out during use. Thereafter the completed toy is ready for packaging and distribution.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. A plush toy comprising:

a body defined at least partially by a fabric having a backing, a second plush layer having a second pile height and fixedly coupled to the backing by a laminate layer and a first plush layer having a first pile height the first pile height greater than the second pile height the first plush layer removably coupled through the backing to permit individual constituent threads of the first plush layer to be manually removed from the backing while the second plush layer remains fixed to the backing, the body defining an internal cavity; and a fill material retained within the internal cavity.

2. The plush toy of claim 1 wherein the first plush layer is of a first thread weight and the second plush layer is of a second thread weight less than the first thread weight.

3. The plush toy of claim 1 wherein the fill material is at least one of: synthetic fiber, cotton, straw, wood, wool, plastic pellets or beans.

4. The plush toy of claim 1 wherein the second plush layer includes one or more aesthetic features, the one or more aesthetic features at least partially occluded by the first plush layer.

5. The plush toy of claim 1 wherein the first plush layer is a first color and the second plush layer is a second different color.

6. The plush toy of claim 1 wherein the body comprises a recloseable opening into an internal recess to receive the first plush layer once removed.

7. The plush toy of claim 6 further comprising:

corresponding regions of hook and loop material to reclose the opening.

8. The plush toy of claim 1 wherein the first pile height is in a range of 3 mm to 10 mm greater than the second pile height.

* * * * *